United States Patent [19]

Hedrick

[11] Patent Number: 4,881,006

[45] Date of Patent: Nov. 14, 1989

[54] METHODS AND APPARATUS FOR POST-ASSEMBLY CUSTOM FINE-TUNING OF AN ELECTRON BEAM CHARACTERISTIC IN A CATHODE RAY IMAGING TUBE

[75] Inventor: Geoffrey S. M. Hedrick, Malverne, Pa.

[73] Assignee: Innovative Solutions & Support, Inc., Malverne, Pa.

[21] Appl. No.: 269,587

[22] Filed: Nov. 10, 1988

[51] Int. Cl.[4] ..... H01J 9/236; H01J 9/44

[52] U.S. Cl. ..... 313/450; 445/3; 445/36

[58] Field of Search ..... 445/3, 4, 36, 58; 313/450

[56] References Cited

U.S. PATENT DOCUMENTS 3,643,299 2/1972 Brown ..... 445/34
4,662,853 5/1987 Veldhoven .

FOREIGN PATENT DOCUMENTS 145474 11/1979 Japan ..... 445/3
212945 10/1985 Japan ..... 445/36

*Primary Examiner*—Kenneth J. Ramsey
*Attorney, Agent, or Firm*—Cohen, Pontani & Lieberman

[57] ABSTRACT

An internal electrostatic field-generating, beam-controlling element in a cathode ray tube is formed by depositing an initially continous layer of resistive material on a substrate and applying a voltage differential across the coating to generate a field-generating current therethrough during operation of the tube. After completion of tube assembly and sealing of the tube envelope, the element is custom fine-tuned by projecting an externally-originating laser beam through the envelope wall to selectively remove portions or areas of the resistive material, thereby predeterminately distorting the electrostatic field and selectively changing the effect of the field on the imaging electron beam. This procedure readily enables both correction of perceived deficiencies in and intentional modifications to one or more characteristics of the electron beam.

41 Claims, 1 Drawing Sheet

METHODS AND APPARATUS FOR POST-ASSEMBLY CUSTOM FINE-TUNING OF AN ELECTRON BEAM CHARACTERISTIC IN A CATHODE RAY IMAGING TUBE

FIELD OF THE INVENTION

The present invention relates to cathode ray imaging tubes and, in particular, to methods and apparatus for providing accurate control of certain characteristics of the imaging electron beam through custom fine-tuning of beam-affecting electrostatic fields.

BACKGROUND OF THE INVENTION

It known that cathode ray imaging tubes manufactured in typically-automated assembly processes exhibit tube-to-tube differences in the focus and/or other electron beam-related aspects or characteristics of screen-carried images generated during normal operation of the tube. These differences typically result from variations in manufacturing and/or component tolerances, orientations, alignments and like factors, the results of which generally become apparent only after assembly of the tube and sealing of its envelope have been completed and the tube tested to examine its operation. Because of the difficulty of minimizing such variations, and the virtual impossibility of eliminating them, during manufacture while economically producing a competitively-priceable product, efforts are made to "fine-tune" each tube after its assembly and sealing. Most comonly, the electrostatic field-effected focusing of the electron beam is adjusted by operating the tube to observe deficiencies or misalignments of the beam on the screen, following which small permanent magnets or the like are selectively secured about the exterior of the tube neck to distort the electrostatic focusing field and, thereby, the effect of the field on the imaging beam. This procedure, although somewhat effective, has a variety of drawbacks including its labor intensive and relatively inexact nature and the substantial possibility that the magnets may at some point during the life of the tube work themselves loose or otherwise shift in position, distorting the focusing field in unanticipated and unintended ways. This procedure is also relatively inflexible and cannot be readily applied to correct or affect other imaging or image-affecting characteristics of the electron beam not directly associated with the operation of the focusing device.

OBJECTS OF THE INVENTION

It is accordingly the desideratum of the invention to provide a method and apparatus for improved and enhanced custom fine-tuning of one or more characteristics of the imaging electron beam in a cathode ray tube.

It is a particular object of the invention to provide such a method and apparatus for custom fine-tuning an electrostatic focusing device within a cathode ray tube after the completion of its assembly and sealing of the tube envelope with unusual accuracy and control.

It is a further object of the invention to provide such a method and apparatus for creating an astygmatic electrostatic focusing lens especially fabricated to compensate for or create, inter alia, astygmatic shapes or assymetrical focus of the beam on the imaging screen in a particular cathode ray tube.

These and other objects and features of the present invention will become apparent from the following detailed description considered in connection with the accompanying drawings. It is to be understood, however, that the drawings are designed solely for purposes of illustration and not as a definition of the limits of the invention, for which referecne should be made to the appended claims.

BRIEF DESCRIPTION OF THE DRAWING

In the drawing, wherein similar reference characters denote similar elements throughout the several views.

DETAILED DESCRIPTION OF THE PREFERRED EMBODIMENTS

In its broadest sense, the present invention is directed to a method of fine-tuning an element or device, generally disposed within the interior of a sealed envelope cathode ray imaging tube, which element or device operatively generates an electrostatic field for controlling at least a characteristic of an imaging electron beam in the tube. The beam characteristic may, by way of example, be or relate to the focus of the beam on the tube's imaging screen—such as the cross-sectional size and/or shape of the beam—or it may involve the dynamically-controlled position of the beam on the screen, or some combination of these or still other aspects of imaging tube operation. The fine-tuning contemplated consists of modifying or otherwise operating on the physical structure of the element or device, generally after completion of the normal assembly of the tube and subsequent to sealing of the tube housing or envelope. In a particularly preferred form of the invention such fine-tuning is performed from outside of the envelope and, advantageously, while or after operating the tube and examining an image operably formed on the tube screen, thereby enabling the fine-tuning to provide suitable compensation for deficiencies in one or more characteristics of the electron beam as evidenced by the said examination of the beam-formed image on the screen. Thus, in accordance with and by way of the improvement of the present invention each individual or particular cathode ray tube assembled in a conventional manufacturing process may, following completion of the normal assembly operations to which all such tubes are subjected, be separately and uniquely modified or fine-tuned to provide suitable correction for tube-to-tube structural, orientational and/or operating variations that affect certain selected characteristics of the electron beam and thereby effectively compensate for beam characteristic-affecting variations or deficiencies found or otherwise known to be present in that individual tube.

Figure 1:
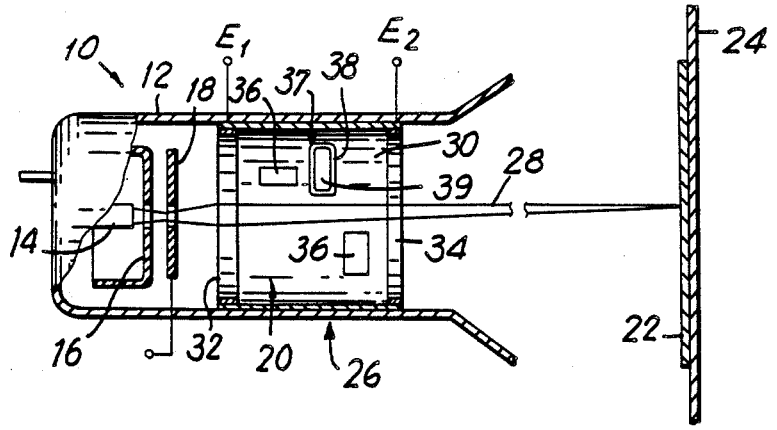
FIG. 1 is a cross-sectional, semi-schematic view, partly broken away, of a cathode ray imaging tube in accordance with the present invention.

A cathode ray imaging tube, identified by the general reference numeral 10 and constructed in accordance with the present invention, is depicted in relevant part in FIG. 1. Tube 10 is conventionally formed in and includes a housing or envelope 12, typically fabricated of glass and which, at the completion of the normal manufacturing process, is generally evacuated and sealed closed. Encased within the tube envelope is a cathode 14, a cup-shaped control grid 16, an optional accelerating electrode 18, an electric field-type electrostatic focusing device 20 and an imaging screen 22 carried on an end wall 24 of the tube envelope 12 remote from the radially constricted envelope neck 26. During normal operation of the tube 10, the cathode 14 is energized and heated by an applied high voltage, causing it to emit electrons which are collimated and accelerated through openings in the control grid 16 and electrode 18 to form an electron beam 28 that is operatively focused on the imaging screen 22. The cathode 14, grid 16, electrode 18 and screen 22 may be conventional and of any known or appropriate construction. As should, of course, be apparent, the tube 10 will also include certain additional structures and elements (not shown) for a variety of purposes—such, for example, as deflectors for causing the beam to sweep back and forth across the target or screen 22 in full-frame scanning sequence as is well known in the art; these additional elements are, however, well known and deemed unnecessary to a ready understanding of the invention and have, accordingly, been omitted from the FIG. 1 depiction of the tube 10.

The focusing device 20 comprises a region of electrically resistive material 30 in the general form of a hollow cylinder oriented along the direction of travel of the electron beam 28 and through the open center of which the beam operatively travels. In the tube 10 of FIG. 1, resistive material is disposed directly on the interior surface or face of the envelope 12, more particularly at or proximate the neck 26. This arrangement advantageously assures virtually perfect mechanical stability of the focusing device since the placement of the electrostatic focus field generator directly on the tube envelope or frame eliminates unintended changes in the focus or shape, or in the orientation or alignment, of the beam as the tube or the tube-containing apparatus is jarred or moved or otherwise physically disturbed.

Electrically conductive strips or bands 32, 34 are disposed in electrical communication with the resistive material 30 at axially opposite ends of the cylindrical region. In the tube 10, each strip 32, 34 extends encirclingly about the entire cylinder circumference although, as will become apparent, other arrangements are within the scope and contemplation of the invention. In the normal operation of the cathode ray tube of the invention a potential or voltage $E_1$ and a voltage $E_2$ are applied to the conductive strips 32, 34, respectively, $E_2$ being typically greater than $E_1$. The potential difference $E_2$-$E_1$—which may, solely by way of example, be in the range of 300 to 400 volts—between the strips 32, 34 produces a voltage gradient through the resistive material 30 and generates a corresponding positionally-varying electrostatic lens field within the interior of the tube neck. The electron beam 28, operatively traveling through the electrostatic field, is thereby focused on the imaging screen 22 as is well understood.

In a currently preferred form of the invention, the resistive material 30 is deposited, during normal assembly of the tube, on the tube envelope 12 as a relatively thin, substantially uniform layer or coating. The resistive material—which may, for example, be implemented using nichrome or a ceramic conductive material—is initially laid down or deposited so as to provide a substantially continuous cylindrical region of such material. The conductive strips 32, 34 may then be similarly deposited directly over or atop the resistive material at the axially opposite ends o the cylindrical focusing device 20, with conductive leads or wires being thereafter suitably secured to the strips for communicating the field-defining voltages $E_1$, $E_2$ thereto. Alternatively, of course, the conductive strips 32, 34 may be laid on the tube wall first, with the resistive material 30 being then deposited directly over or atop and between the strips.

With the remaining internal tube elements and structures conventionally or otherwise assembled within the envelope 12, the envelope is normally sealed closed, generally after first evacuating it of air and, if considered appropriate, filling the tube with a gas or mixture of gases selected to facilitate its image-generating function. The tube 10 is then, in accordance with the method of the invention, operated to generate an image on the screen 22, which image is examined to identify deficiencies or unintended variations in one or more characteristics of the image-forming electron beam. As previously pointed out, these characteristics may include the form or shape of the beam as it impinges on the imaging screen, or the position—e.g. actual versus intended—of the beam on the screen, or any other beam quality or attribute that is controlled or affected by, or correctable through modification of, the electrostatic field generated by the focusing device 20. For example, the present invention may be advantageously employed to correct astigmatism imparted to the beam, as a result of structural imperfections or misalignments of operating elements of the tube, as the beam passes through the deflection field. Or, again by way of example, the invention can be employed to impart a predetermined cross-sectional shape to the beam at the screen 22—such as enhanced circularity or roundness of the beam dot, or an oval configuration particularly suitable where the imaging phosphors on the screen are arranged as elongated lines or elements—irrespective of tube-to-tube variations in the alignment or geometry or structural attributes of the tube's operating elements. By way of the present invention, suitable electrostatic field-effected compensation for deficiencies in one or more such characteristics of the imaging electron beam 28 is readily, and permanently, imparted to the beam to, in effect, custom fine-tune each individual tube.

The currently preferred manner is which such fine-tuning or compensation is performed and provided, in accordance with the invention, will now be described with continued reference to FIG. 1. Following said examination of the image generated on the tube screen 22 and the identification therefrom of deficiencies or the like in the beam characteristic(s) of interest, one or more selected portions of the resistive material are cut out or removed from the cylindrical layer of such material so as to create one or more voids or discontinuities 36 in the intially continuous region which defines the focusing device 20. As should be apparent, these voids or discontinuities create localized interruptions in the voltage gradient across and about the cylindrical region of resistive material 30 and, therefore, correspondingly localized distortions and interruptions and variations in the electrostatic focusing field generated by the device 20 and through which the electron beam travels. The size, configuration and location of the discontinuities are predeterminately selected, in accordance with the results of the examination of the image generated on the tube screen 22, to provide those electrostatic field-imparted adjustments of the electron beam necessary to impart the desired characteristic(s) to the beam and, correspondingly, to the screen-borne image. Thus, for example that the discontinuities 36 illustrated in FIG. 1 are generally rectangular is not meant to suggest that any or all such discontinuities need be of any particular shape or pattern—so long as they result in appropriate adjustment of the beam-controlling electrostatic field.

It should further be noted that while the discontinuities 36 are depicted in FIG. 1 as being formed of areas in which all of the resistive material has been removed within the continuous edge or boundary of the resulting void other, substantially equivalent, arrangements may also or alternatively be employed. For example, the discontinuity 37 comprises a geometrically continuous boundary zone or strip 38 wherein the resistive material has been removed and within the bounded interior of which there remains a land 39 of resistive material. Since the land 39 is entirely surrounded by the zone 38 and thus electrically isolated from the remainder of the resistive material 30 across which the potential difference $E_2$- $E_1$ is applied, however, no current flows through the land 39 and, in effect, the generated electrostatic field includes the same locallized distortion that it would have had were the resistive material of the land 39 completely removed from the supporting envelope wall 12.

In a currently preferred embodiment of the invention, the creation of the voids and discontinuities 36 is carried out after sealing of the tube 10 and, therefore, through a wall of the sealed envelope 12 from an outside location. In a particularly preferred implementation, a suitably powered laser beam (not shown) is directed, from outside of the tube, through the wall of the envelope 12 and onto the resistive material 30 at those locations at which it is desired to create the discontinuities 36, 37. In this manner the resistive material 30 is burned away or vaporized at the intended locations of and to thereby create the voids and discontinuitites 36, 37. Any suitable laser—such as a neodinium glass laser, or a YAG (yttrium-aluminum-gallium) laser, or a medium power carbon dioxide laser as is conventionally utilized in the fabrication of integrated circuits—may be employed for this purpose.

The result of this process is the creation of an astigmatic electrostatic focusing lens especially fabricated to compensate for or correct, inter alia, astigmatic shapes of the beam cross-section or assymetrical focus of the beam on the imaging screen in the individual or particular cathode ray tube 10, or to otherwise modify the beam shape or location in a predetermined manner. The laser or otherwise-effected custom modification of the initially continuous region of resistive material 30 of the focusing device 20 is capable of being carried out quickly and easily and in accordance with the results of an actual imaging operation of the individual tube 10. It may, in addition, be performed manually by a technician, for example, who directly observes and examines the screen image and correspondingly operates the laser to create the discontinuities 36, 37 or, on the other hand, in a fully or at least partially automated arrangement utilizing suitable scanning, logic and/or laser-orienting and control apparatus.

Figure 2:
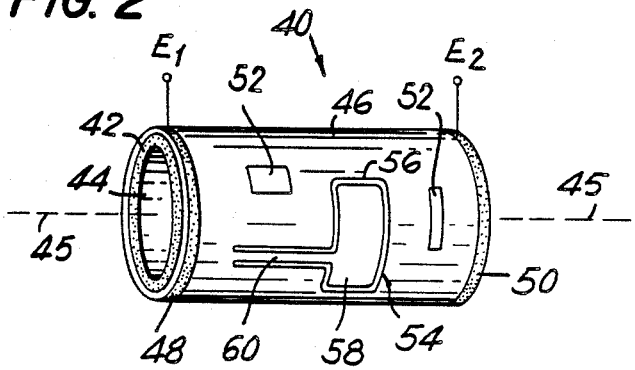
FIG. 2 is a side view of an electrostatic field-generating focusing device constructed in accordance with the invention.

It is also within the contemplation of the invention to deposit the resistive material 30 on a substrate or support separate and distinct from, or at least other than, the wall of the tube envelope 12 with the substrate suitably secured to the envelope or to some other internal tube structure for fixing its relative location and orientation in the tube. Depicted by way of example in FIG. 2 is an alternative focusing device 40 comprised of a generally nonconductive frame or substrate 42 of tubular or cylindrical configuration and having an axially open center 44. The manner of securing the substrate 42 within the tube is not shown and is, in any event, a matter of design choice. In any event, the focusing device 40 is oriented within the tube so that the electron beam passes substantially centrally through its open interior 44 and along its axis 45. A layer of resistive material 46 is deposited or laid over the outwardly-disposed face of the cylinder 42, as are electrically communicating and conductive strips or bands 48, 50 at or proximate the axially-opposite ends of the tubular substrate and the region of resistive material for operatively receiving the respective voltage potentials $E_1$, $E_2$. The focusing device 40 is further provided with one or more voids or discontinuities 52 for locally interrupting the flow of current through and the resulting voltage gradient on the resistive layer, and correspondingly distorting and interrupting and varying the electrostatic focusing field generated thereby and through which the electron beam travels. The discontinuities 52 may, in addition to the form of those identified 36 in FIG. 1, also or alternatively be of the type represented by the reference numeral 37.

Those skilled in the art will, in any event, appreciate that the focusing device 40 is further subject to the same broad range of modifications in and additions to its structure and in the method and materials of its fabrication as heretofore described or contemplated in respect of the focusing device 20 of FIG. 1. Moreover, the substrate 42 may be configured as other than a mere hollow tube or cylinder; it may, solely for example, further include one or more ribs which project radially-inwardly from the circumferential wall a distance less than the tube radius—particularly at an axial end of the tube—in accordance with the construction of heretofore known elements of electrostatic focusing devices in cathode ray imaging tubes. All such modifications are within the full scope and intention of the invention.

The focusing device 40 (or, indeed, the device 20 of FIG. 1) may also include a discontinuity 54 of somewhat different construction than the basic-form discontinuities 52 (or 36) which, in effect, constitute predeterminately shaped and sized areas within the edges or bounds of which all of the resistive material has been removed. Like that denoted 37 in FIG. 1, the discontinuity 54 includes an outer boundary area or zone 56 in which the resistive material has been removed. The zone 56, however, only partly surrounds or encircles an area 57—formed of a land 58 and a relatively narrow bridge 60 connecting the land 58 to the main body or region of resistive material 46—in which the resistive material has not been removed and thus remains on the substrate. As should be apparent, there is no outlet for and therefore substantially no current flow through the land 58 and bridge 60 of discontinuity 54 and, consequently, no voltage drop throughout the area 57. Thus, the voltage is basically uniform throughout the area 57 and is the same as the voltage at the connection of the bridge 60 to the main region of resistive material 46—i.e. at that end of the elongated bridge opposite the juncture of the bridge and the land 58. The discontinuity 54, then, generates an electrostatic field strength proportional to the uniform voltage throughout its area 57 and, at least with respect to the land 58, the resulting uniform strength portion of the field is at the same strength as the generated field at a location upstream thereof—i.e. at the juncture of the bridge 60 and the main region of resistive material. Indeed, where the bridge 60 is sufficiently narrow, as is preferred, its contribution to the electrostatic field will be sufficiently minimal so that the portion of the electrostatic field which is generated as a result of the voltage on the land 58 will effectively provide an isolated "island" having a field strength substantially equal to the field strength at an axially-remote, typically (but not necessarily) upstream, location of the electrostatic field. Those skilled in the art will appreciate the value of this ability to create such in effect isolated regions of selected field strengths in the electrostatic field for correcting perceived irregularities in or otherwise controlling selected characteristics of the imaging electron beam.

Figure 3:
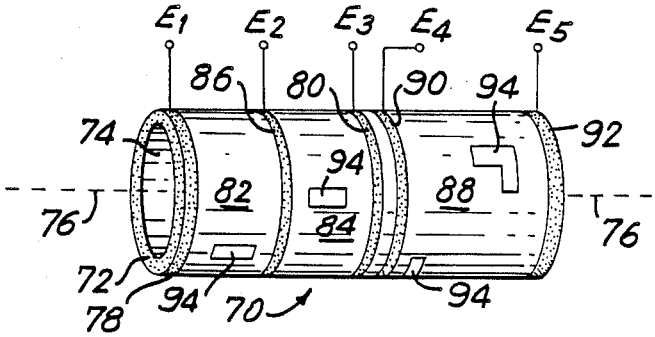
FIG. 3 is a side view of another electrostatic field-type focusing device in accordance with the invention.

The present invention may alternatively be implemented in an arrangement having a series or multiplicity of regions of resistive material across each of which a voltage difference is operatively applied for generating one or more beam-controlling electrostatic fields. Such multiple regions may be deposited directly on the tube envelope, as in the device 20 (FIG. 1), or on a separate substrate as in the device 40 (FIG. 2). Thus, FIG. 3 depicts, by way of example, a third form of focusing device, here identified by the reference numeral 70. The device 70, like the device 40 of FIG. 2, is generally intended for operative placement in or proximate the neck of a cathode ray imaging tube. It comprises a substrate 72, here hollow and tubular with an open center 74, on which is deposited a resistive material through which electric current is passed to generate an electrostatic focusing field for an electron beam traveling substantially along its axis 76 The resistive material is applied in a plurality of regions disposed axially along the cylindrical substrate, each physically and, if desired, electrically isolated from the other(s), and at least a pair of conductive strips or bands are deposited on or connected to each such region for supplying voltage potentials thereto.

In the device 70 of FIG. 3, for example, an initially continuous region of resistive material extends between conductive bands 78, 80 and is separated into parts 82, 84 by a third conductive band 86. Any suitable combination of voltages $E_1$, $E_2$, $E_3$ may be operatively applied to the bands 78, 86, 80, respectively. A completely separate, physically isolated region 88 of resistive material lies on the substrate 72 axially spaced from the part 84 and bounded by a pair of conductive bands 90, 92 to which voltage potentials $E_4$, $E_5$ are operatively applied. Discontinuities 94—of any of the types heretofore disclosed—are selectively defined, in accordance with the invention, at one or more appropriate locations along the resistive material of the device 70.

Those of ordinary skill in the art, given knowledge of this disclosure, will recognize that numerous variations and changes in the number, configuration and size, for example, of the region(s) of resistive material deposited in accordance with the express descriptions herein may be made and are within the scope of the invention. Thus, regions of resistive material of noncylindrical—indeed of virtually any—shape may be employed for suitably focusing the imaging electron beam. Furthermore, regions of resistive material may be juxtaposed, in a substantially regular pattern or a seemingly random arrangement, or otherwise associated with regions fabricated of a conductive material such as aluminum or other metals commonly used in producing conventional electrostatic lens-generating focusing elements. These and other modifications are both contemplated and intended.

Similarly, it will be recognized that the present invention, comprising in its most basic sense a method and apparatus for custom fine-tuning an electrostatic field in a cathode ray tube to correct or control a characteristic of the imaging electron beam, is not limited to implementations wherein the electrostatic field is generated by or associated with a focusing device. Electrostatic fields for controlling the scanning movement of the beam vertically and/or horizontally across the imaging screen, or especially provided fine-tuning fields which are in addition to those normally present in a conventional tube, by way of example, may be constructed or utilized in accordance with the improvement of the present invention.

Moreover, although the foregoing descriptions have been generally directed to monochrome or single-beam cathode ray imaging tubes, the invention may be equally readily applied to and implemented in multibeam, e.g. color, tubes.

Thus, while there have been shown and described and pointed out fundamental novel features of the invention as applied to preferred embodiments thereof, it will be understood that various omissions an substitutions and changes in the form and details of the devices illustrated and in their operation, and in the methods of the invention, may be made by those skilled in the art without departing from the spirit of the invention. It is the intention, therefore, to be limited only as indicated by the scope of the claims appended hereto.

What is claimed is:

1. A method of selectively adjusting the focus of an imaging electron beam in a sealed envelope cathode ray tube having an imaging screen to impart a predetermined crosssectional shape to the beam at the imaging screen, comprising the steps of:

depositing within the tube a substantially continuous region of electrically resistive material;

applying a voltage difference across the region of resistive material to generate within the tube a positionally-varying electrostatic field through which the electron beam operatively passes in the operation of the tube; and selectively removing the resistive material in at least a portion of said region to selectively vary the positionally-varying electrostatic field and thereby predeterminately adjust the cross-sectional shape of the electron beam at the imaging screen, said removal step comprising burning away said selected portion of resistive material through the sealed envelope of the tube.

2. The method in accordance with claim 1, said removal step comprising selectively operating a laser disposed exteriorly of the tube so as to burn away with the laser, through the sealed envelope of the tube, the resistive material in at least a portion of said region.

3. The method in accordance with claim 1, further comprising:

operating the tube, while applying said voltage difference across said region of resistive material, so as to cause the electron beam to produce an image on the screen;

examining the image produced on the screen; and selectively removing the resistive material in at least a portion of said region on the basis of said examination of the image produced on the screen so as to adjust said image for imparting the predetermined cross-sectional shape to the beam by selectively varying the positionally-varying electrostatic field generated by the voltage difference applied across said region of resistive material.

4. The method in accordance with claim 1, wherein the substantially continuous region of electrically resistive material is deposited o a substrate disposed within the interior of the tube.

5. The method in accordance with claim 4, wherein the substrate is the tube envelope.

6. The method in accordance with claim 1, wherein the tube envelope has a neck disposed remote from the imaging screen and through which the electron beam operatively passes to produce an image on the screen, the substantially continuous region of electrically resistive material being deposited proximate the neck of the tube envelope.

7. The method in accordance with claim 6, wherein the electrically resistive material is deposited on the tube envelope.

8. The method in accordance with claim 1, wherein the electrically resistive material is deposited substantially in the form of a cylinder through which the beam operatively passes in the operation of the tube.

9. The method in accordance with claim 6, wherein the electrically resistive material is deposited substantially in the form of a cylinder through which the beam operatively passes in the operation of the tube.

10. The method in accordance with claim 9, wherein the electrically resistive material is deposited on the envelope of the tube.

11. The method in accordance with claim 1, wherein said removing step further comprises selectively removing resistive material from said region so as to produce at least an area of said region having a substantially constant voltage within said area and correspondingly produce in said electrostatic field at least an area having a substantially constant electrostatic field.

12. The method in accordance with claim 1, wherein said resistive material is nichrome.

13. The method in accordance with claim 1, wherein said resistive material is a ceramic conductive material.

14. The method in accordance with claim 1, wherein said electrically resistive material is deposited within the tube so as to provide a substantially uniform resistance throughout said region.

15. The method in accordance with claim 1, wherein said depositing step further comprises depositing at least two areas of conductive material at spaced apart locations of said region, said voltage difference being applied to said region at said two areas of conductive material to produce a voltage gradient across said region and thereby generate said positionally-varying electrostatic field.

16. An electrostatic lens operable for focusing an electron beam on a focusing screen in a sealed envelope cathode ray tube, comprising:

a lens element having an axially-defined substantially central opening through which the electron beam passes and to which an electrical potential is operatively applied;

a substantially continuous region on said lens element formed of an electrically resistive material and providing a voltage gradient across said region to generate a substantially uniformly positionally-varying electrostatic field which operates on the electron beam as the beam passes through said lens element opening;

said region having at least a discontinuity lacking said resistive material so as to create a nonuniformity in said substantially uniformly positionally-varying electrostatic field;

said discontinuity being defined with a configuration and at a location of said region predeterminately selected in accordance with the operating characteristics of the particular tube by operating the tube to produce an image on the screen, examining the image, and defining in accordance with said examination of the image a suitable configuration and location for said discontinuity by which the cross-sectional shape of the electron beam is adjusted by the electrostatic field as the beam passes through said lens opening to attain a predetermined cross-sectional shape of the beam, whereby said discontinuity provides compensation for tube-to-tube beam focus-affecting variations in the operating characteristics of the tube so as to assure attainment of the predetermined cross-sectional shape to the beam in each particular tube.

17. An electrostatic lens in accordance with claim 16, wherein said substantially continuous region of resistive material is in the form of a cylinder through which the electron beam passes.

18. An electrostatic lens in accordance with claim 16, wherein said region of resistive material is formed on the tube envelope.

19. An electrostatic lens in accordance with claim 17, wherein said region of resistive material is formed on the tube envelope.

20. An electrostatic lens in accordance with claim 16, wherein said region of resistive material is depositedon a substantially nonconductive substrate.

21. An electrostatic lens in accordance with claim 16, wherein said discontinuity is defined after sealing of the tube envelope.

22. An electrostatic lens in accordance with claim 16, wherein the tube envelope has a neck disposed remote from the imaging screen and through which the electron beam passes to produce an image on the screen, the substantially continuous region of resistive material being disposed proximate the neck of the tube envelope.

23. An electrostatic lens in accordance with claim 16, wherein said discontinuity defines an area of resistive material having a substantially constant voltage within said area for generating a corresponding area of said field having a substantially constant electrostatic field.

24. An electrostatic lens in accordance with claim 16, wherein said resistive material has a substantially uniform resistance throughout said region so as to provide a substantially uniform voltage gradient across said region.

25. An electrostatic lens in accordance with claim 16, wherein said resistive material is one of nichrome and a ceramic conductive material.

26. A method of fine-tuning an electron beamcontrolling electrostatic field-generating device in a sealed envelope cathode ray tube having an imaging screen, comprising the steps of:

depositing a region of electrically resistive material on a support in the tube;

applying a voltage difference across said region of resistive material to generate in the tube an electrostatic field for controlling a characteristic of the electron beam during operation of the tube; and removing at least one selected portion of said region of resistive material by directing a laser beam which originates outside of the tube envelope through a wall of the envelope and onto the resistive material so as to burn away said selected portion of resistive material and thereby predeterminately adjust the electrostatic field for optimizing the field-controlled characteristic of the beam.

27. A method in accordance with claim 26, further comprising operating the cathode ray tube to produce a beam-generated image on the screen, examining said characteristic of the beam in the image generated on the screen, and controlling said removing of at least one selected portion of said region of resistive material in accordance with said examination of the beam characteristic to thereby adjust the electrostatic field for optimizing said beam characteristic.

28. A method in accordance with claim 26, wherein the field-generating device controls the focus of the electron beam on the imaging screen.

29. A method in accordance with claim 28, wherein said characteristic is the cross-sectional shape of the electron beam.

30. A method in accordance with claim 26, wherein said characteristic is the cross-sectional shape of the electron beam.

31. A method in accordance with claim 26, wherein the support on which the resistive material is deposited is the tube envelope.

32. A method in accordance with claim 26, wherein the tube envelope has a neck disposed remote from the imaging screen and through which the electron beam operatively passes to produce an image on the screen, the region of electrically resistive material being deposited proximate the neck of the tube envelope.

33. A method in accordance with claim 32, wherein the support on which the resistive material is deposited is the tube envelope.

34. A method in accordance with claim 26, wherein the electrically resistive material is deposited substantially in the form of a cylinder through which the beam operatively passes in the operation of the tube.

35. A method in accordance with claim 31, wherein the electrically resistive material is deposited substantially in the form of a cylinder through which the beam operatively passes in the operation of the tube.

36. A method in accordance with claim 26, wherein said electrostatic field generated by said voltage difference is positionally-varying field, and said removing step further comprises selectively removing resistive material from said region so as to produce at least an area of said region having a substantially constant voltage within said area and correspondingly produce at least an area of said field having a substantially constant electrostatic field.

37. A method in accordance with claim 26, wherein said electrostatic field generated by said voltage difference is a substantially uniformly positionally-varying field, and said removing step further comprises selectively removing resistive material from said region so as to produce at least an area of said region having a substantially constant voltage within said area and correspondingly produce at least an area of said field having a substantially constant electrostatic field.

38. A method in accordance with claim 26, wherein said electrically resistive material is deposited within the tube so as to provide a substantially uniform resistance throughout said region.

39. A method in accordance with claim 26, wherein said resistive material is nichrome.

40. A method in accordance with claim 26, wherein said resistive material is a ceramic conductive material.

41. A method in accordance with claim 26, wherein said depositing step further comprises depositing at least two areas of conductive material at spaced apart locations of said region, said voltage difference being applied to said region at said two areas of conductive material to produce a voltage gradient across said region and thereby generate said positionally-varying electrostatic field.

* * * * *